US010502401B2

(12) United States Patent
Isayama

(10) Patent No.: US 10,502,401 B2
(45) Date of Patent: Dec. 10, 2019

(54) LIGHTING ELEVATING APPARATUS

(71) Applicant: ISA CO., LTD., Yokohama-shi, Kanagawa (JP)

(72) Inventor: Kiyoshi Isayama, Tokyo (JP)

(73) Assignee: ISA CO., LTD., Yokohama-shi (JP)

( * ) Notice: Subject to any disclaimer, the term of this patent is extended or adjusted under 35 U.S.C. 154(b) by 0 days.

(21) Appl. No.: 16/093,700

(22) PCT Filed: Apr. 17, 2017

(86) PCT No.: PCT/JP2017/015511
§ 371 (c)(1),
(2) Date: Oct. 15, 2018

(87) PCT Pub. No.: WO2017/183616
PCT Pub. Date: Oct. 26, 2017

(65) Prior Publication Data

US 2019/0078765 A1 Mar. 14, 2019

(30) Foreign Application Priority Data

Apr. 21, 2016 (JP) ..... 2016-085538

(51) Int. Cl.
*F21V 21/38* (2006.01)
*F21V 21/16* (2006.01)
(Continued)

(52) U.S. Cl.
CPC ..... *F21V 21/16* (2013.01); *F21S 8/061* (2013.01); *F21V 21/38* (2013.01); *F21W 2131/406* (2013.01)

(58) Field of Classification Search
CPC ..... F21S 8/061; F21V 21/38
(Continued)

(56) References Cited

U.S. PATENT DOCUMENTS 2,348,987 A * 5/1944 Lock ..... B66D 1/38 200/47
3,809,334 A * 5/1974 Beurer ..... B64D 1/22 242/397.3
(Continued)

FOREIGN PATENT DOCUMENTS

CN 101421176 A 4/2009
CN 102359725 A 2/2012
(Continued)

OTHER PUBLICATIONS

Aug. 28, 2017 Office Action issued in Chinese Patent Application No. 201611215332.7.
(Continued)

*Primary Examiner* — Christopher M Raabe
(74) *Attorney, Agent, or Firm* — Oliff PLC

(57) ABSTRACT

A lighting elevating apparatus includes: a reel coupled to a motor and rotated around an axis of a surface in a short direction of the reel including a reel wire reeling face and being arranged such that its longitudinal direction is in a vertical state; a reel wire to be reeled on the reel wire reeling face; a reeling guide including a reel wire touching part facing the reel wire reeling face and being arranged in parallel to the reel, wherein a distance between the reel wire reeling face and the reel wire touching part is equal or less than a diameter of the reel wire; and a connector attached to an end of the reel wire to connect an object, wherein the reeling guide counter-rotates, and the reel wire passes between the reel wire reeling face and the reel wire touching part.

5 Claims, 11 Drawing Sheets

(51) Int. Cl.
*F21S 8/06* (2006.01)
*F21W 131/406* (2006.01)

(58) Field of Classification Search
USPC ..... 362/391
See application file for complete search history.

(56) References Cited

U.S. PATENT DOCUMENTS

| | | | | |
|---|---|---|---|---|
| 4,087,060 | A * | 5/1978 | Laky | B65H 54/2803 242/399.1 |
| 4,150,801 | A * | 4/1979 | Ikegami | H01F 41/082 242/478.1 |
| 4,312,496 | A * | 1/1982 | Norminton | B63B 21/56 114/254 |
| 4,746,100 | A * | 5/1988 | Davenport | B66D 5/26 188/106 F |
| 6,435,447 | B1 * | 8/2002 | Coats | E21B 19/22 242/483 |
| 10,093,522 | B1 * | 10/2018 | Baugh | B66D 1/36 |
| 2005/0087644 | A1 * | 4/2005 | Kim | B65H 75/425 242/390.8 |
| 2008/0217460 | A1 | 9/2008 | Shin | |
| 2008/0247179 | A1 | 10/2008 | Isayama | |
| 2011/0193037 | A1 | 8/2011 | Smith | |
| 2013/0187105 | A1 * | 7/2013 | Xydias | B66D 1/30 254/277 |
| 2014/0084229 | A1 * | 3/2014 | Morrison | B66D 1/00 254/344 |
| 2017/0247235 | A1 * | 8/2017 | Hall | B66D 1/38 |

FOREIGN PATENT DOCUMENTS

| | | | |
|---|---|---|---|
| CN | 202265354 | U | 6/2012 |
| CN | 204057805 | U | 12/2014 |
| EP | 2 985 742 | A1 | 2/2016 |
| JP | H03-88697 | A | 4/1991 |
| JP | H07-211127 | A | 8/1995 |
| JP | 2005-075615 | A | 3/2005 |
| JP | 2008-091152 | A | 4/2008 |
| JP | 2008-257961 | A | 10/2008 |
| JP | 4540212 | B2 | 9/2010 |
| JP | 5173231 | B2 | 4/2013 |
| KR | 100779356 | B1 | 11/2007 |
| KR | 10-2010-0040648 | A | 4/2010 |
| TW | M440384 | U1 | 11/2012 |
| WO | 2014/204244 | A1 | 12/2014 |

OTHER PUBLICATIONS

Aug. 26, 2017 Notice of Allowance issued in Korean Patent Application No. 10-2016-0176545.

Oct. 23, 2018 International Preliminary Report on Patentability issued in International Application No. PCT/JP2017/015511.

Jun. 6, 2017 International Search Report issued in International Application No. PCT/JP2017/015511.

Aug. 20, 2019 Search Report issued in European Patent Application No. 17785954.3.

* cited by examiner

LIGHTING ELEVATING APPARATUS

TECHNICAL FIELD

The present disclosure relates to a lighting elevating apparatuses, and in particular, relates to a lighting elevating apparatus which elevates a lighting element for applying illumination light from above a stage in stage direction.

BACKGROUND ART

In stage direction for supporting presenters to perform productions such as plays and dances, stage lighting systems are used. Such stage lighting systems are roughly classified, according to their installing locations, into a lighting system that applies light from above a stage, a lighting system that applies light from the floor surface of the stage, a lighting system that applies light from the side of the stage, and a lighting system that applies light from audience seating. The lighting system that applies light from above the stage (hereinafter referred to as an "above-stage lighting system") elevates the lighting element which is connected to a reel wire and suspended from a suspension baton. The suspension baton is a device having a receptacle box in which a power receptacle for tool connection is incorporated. The lighting element elevates by reeling a reel wire on the reel and unreeling it from the reel by use of an electric motor.

As disclosed in PTL 1, there is a lighting system which controls elevation of a lighting element and controls light to produce stage direction. The lighting system includes a lighting elevating apparatus which elevates the lighting element by reeling up a reel wire connecting the lighting element on a reel and unreeling it from the reel. Three-dimensional performance is achieved by chronologically changing the length of the reel wire connecting the lighting elevating apparatus with the lighting element and the light to be emitted from the lighting element.

CITATION LIST

Patent Literature

[PTL 1] Japanese Patent No. 5173231

[PTL 2] Japanese Patent Laid-Open No. H07-211127 (1995)

SUMMARY OF INVENTION

In order to make the stage performance more gorgeous, the above-stage lighting system tends to have a plurality of lighting elements suspended from the suspension baton (that is, a plurality of lighting elevating apparatuses are suspended from the suspension band). Under such circumstances, multiple lighting elevating apparatuses are suspended from the suspension baton, thereby causing tremendous burden on the suspension baton. Further, the more the lighting elevating apparatus weighs, the higher the risk of dropping the lighting elevating apparatus in the middle of the stage performance becomes. In order to prevent such a risk, it is desirable that the lighting elevating apparatus have a lightweight and simple structure.

In addition, since the above-stage lighting system elevates the lighting element in the middle of the stage performance, it is desirable that the elevation of the lighting element be made smoothly. However, in the above-described lighting elevating apparatus, due to a displacement (see FIG. 1A) and/or a slack (see FIG. 1B) of the reel wire in reeling the reel wire on the reel, the reel wire is entangled and such entanglement stops the elevation of the lighting element. Such an event is critical in the stage performance, and it is desirable that the occurrence of the above-described displacement and/or slack be avoided.

PTL 2 discloses an elevation type luminaire in which a power supply cord 9 is constantly stretched by using a reeling device 3. However, the elevation type luminaire disclosed in PTL 2 merely prevents the power supply cord 9 from loosening by the reeling force of the reeling device 3. Further, the elevation speed of the luminaire is set to be stable by merely setting the reeling force of the reeling device to a force equivalent to the weight of a supply part of the power supply cord. Accordingly, the elevation type luminaire of PTL 2 does not completely prevent the occurrence of the displacement and/or slack in reeling up a reel wire.

An embodiment of the present invention provides a lighting elevating apparatus which has a lightweight and simple structure and which avoids occurrence of displacement and/or slack in reeling up the reel wire.

A lighting elevating apparatus according to an embodiment of the present invention includes: a reel including a reel wire reeling face and being arranged such that its longitudinal direction is in a vertical state, wherein the reel is coupled to an electric motor and is rotated around an axis of a surface in a short direction of the reel by the electric motor; a reel wire to be reeled on the reel wire reeling face by the rotation of the reel; a reeling guide including a reel wire touching part facing the reel wire reeling face and being arranged in parallel to the reel, wherein a distance between the reel wire reeling face and the reel wire touching part is equal to or less than a diameter of the reel wire; and a connector attached to an end of the reel wire to connect a to-be-lifted object that is to be suspended below the lighting elevating apparatus, wherein the reeling guide counter-rotates with respect to the rotation of the reel and the reel wire passes between the reel wire reeling face and the reel wire touching part.

The structure of the lighting elevating apparatus according to an embodiment of the present invention allows the reel wire free from displacement and/or slack only by providing a reeling guide that contacts with the reel wire. Further, no other component to avoid the displacement and/or slack of the reel wire is required to achieve the lightweight and simple structure.

DESCRIPTION OF EMBODIMENTS

With reference to the attached drawings, the lighting elevating apparatus according to an embodiment of the present invention will be explained. The lighting elevating apparatus of an embodiment of the present invention is used by suspending it in a state in which its longitudinal direction is vertically set. The terms "above," "below," "upper part," "lower part," "upper end," and "lower end" each refers to the upper part or lower part of the vertically-suspended lighting elevating apparatus, as viewed on the ground.

First Embodiment

Figure 1A:
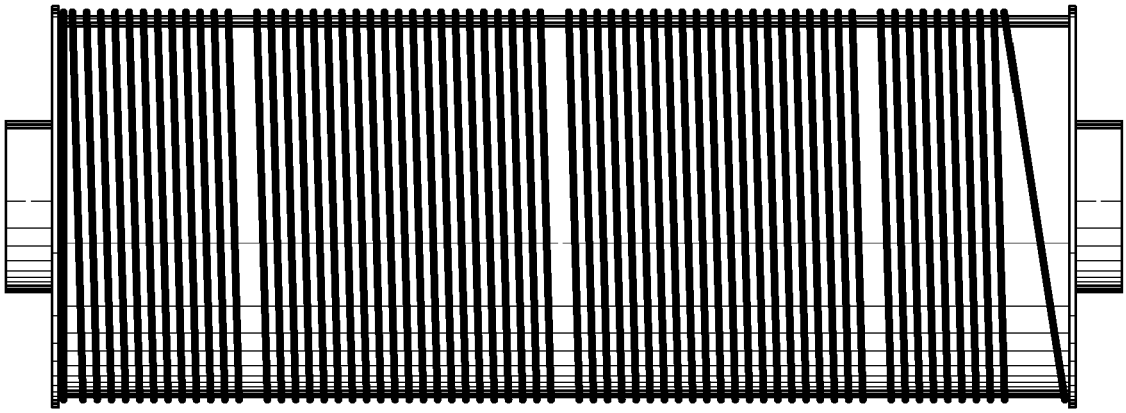
FIG. 1A is a view showing an example of a lighting elevating apparatus according to the prior art.
Figure 1B:
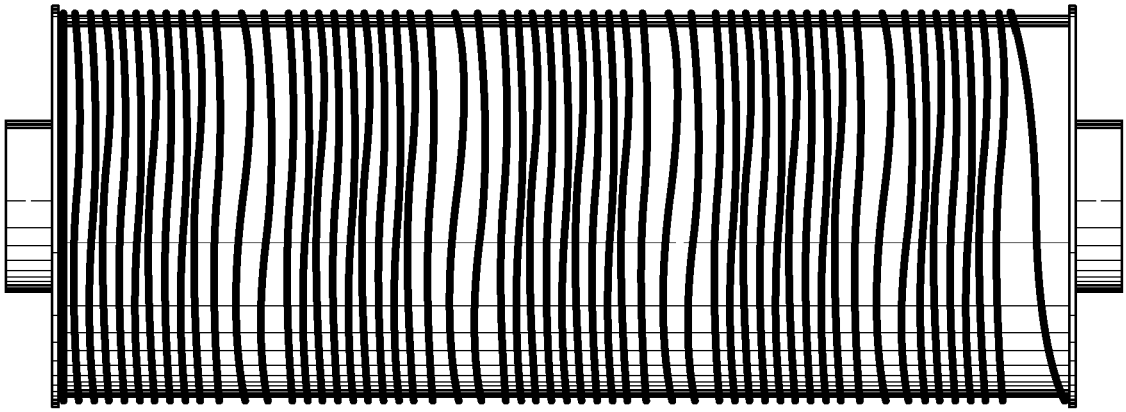
FIG. 1B is a view showing an example of a lighting elevating apparatus according to the prior art.
Figure 2:
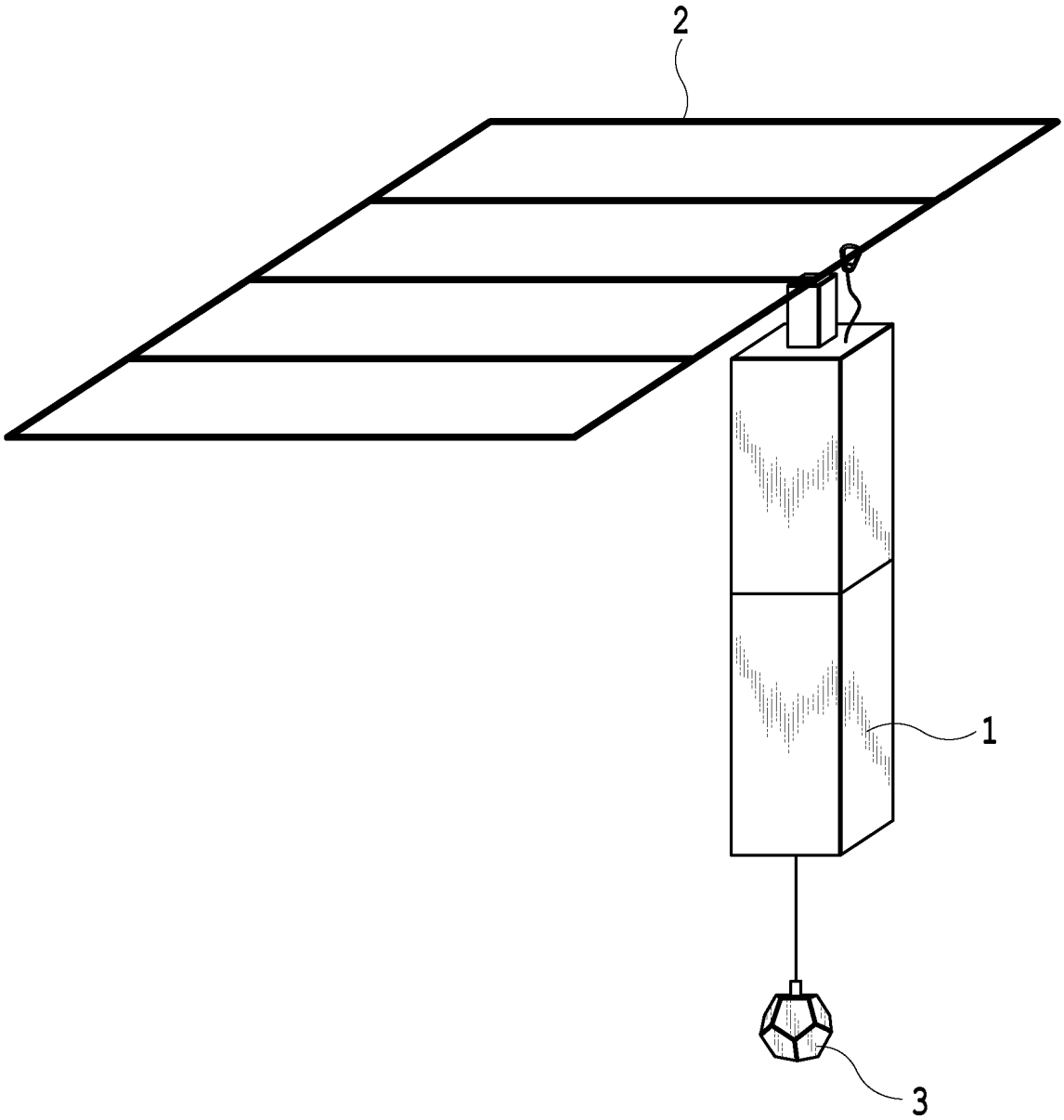
FIG. 2 is a view showing an entire lighting system according to a first embodiment of the present invention.

FIG. 2 is a view showing an entire lighting system according to a first embodiment of the present invention. The lighting system includes a lighting elevating apparatus 1, a suspension baton 2, and a lighting element 3. The upper end of the lighting elevating apparatus 1 is coupled to the suspension baton 2 and is suspended from the suspension baton 2. As shown in FIG. 2, the lighting elevating apparatus 1 is suspended with its longitudinal direction being vertically set. The lighting elevating apparatus 1 uses an electric motor provided therein to rotate the reel, whereby the reel wire having the lighting element 3 attached thereto is reeled on the reel and unreeled from the reel to cause the lighting element 3 to ascend/descend. The elevation of the lighting element 3 is controlled by a control device (not shown) connected to the lighting elevating apparatus 1 through software control.

The suspension baton 2 is a stage mechanism which is arranged on the ceiling of the stage and which suspends the lighting elevating apparatus 1. The suspension baton 2 is also a device having a receptacle box in which a tool-connecting power receptacle that connects the power supply of the lighting elevating apparatus 1 is incorporated. The suspension baton 2 according to the present embodiment is well known, and therefore, an explanation in detail will be omitted.

The lighting element 3 is a light source that applies light from above the stage. The lighting element 3 is connected to the reel wire and is suspended below the lighting elevating apparatus 1. The lighting element 3 is a lighting element having any shape, and has halogen light or a Light-Emitting Diode (LED). The lighting element 3 is, when considering the burden on the suspension baton 2, desirably lightweight. The lighting element 3 according to the present embodiment is also well known, and therefore, an explanation in detail will be omitted.

Next, with reference to FIG. 3, the structure of the lighting elevating apparatus 1 according to the first embodiment of the present invention will be explained. The lighting elevating apparatus 1 includes a casing 10, a reel 11, a reel wire 12, a reeling guide 13, an electric motor 14, a guide screw 15, a clutch 16, a pulley 17, a column 18, an attaching part 19, and an attaching hook 20.

Figure 3:
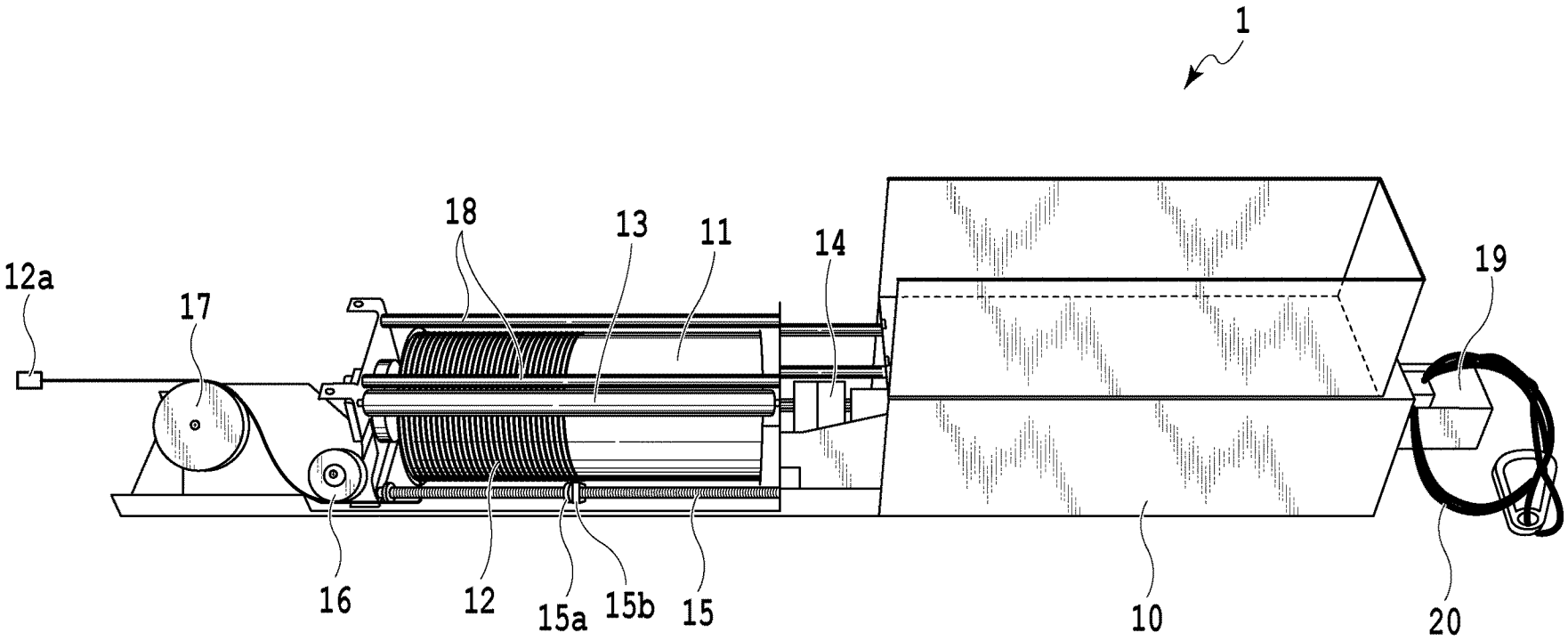
FIG. 3 is a view showing an entire lighting elevating apparatus according to the first embodiment of the present invention.

The casing 10 is a casing having a rectangular parallelepiped shape and covers the entire lighting elevating apparatus 1, and, as shown in FIG. 3, has an openable structure. This openable structure facilitates maintenance task such as replacing the reeling guides 13 located inside the lighting elevating apparatus 1. The casing 10 is desirably made of lightweight material such as plastics or resins.

The reel 11 has a cylindrical shape, and is arranged such that its longitudinal direction is parallel to the longitudinal direction of the casing 10. The reel 11 is coupled to the electric motor 14, and is rotated around an axis in a short direction of the reel 11 by operation of the electric motor 14. Such rotation of the reel 11 reels up the reel wire 12 in a single layer, and the counter-rotation of the reel 11 unreels the reel wire 12. The reel 11 is desirably made of lightweight material such as aluminum. It should be noted that the shape of the reel 11 is not limited to the cylindrical shape, but may be a rectangular shape when viewed in the longitudinal direction and may be any equilateral isogon such as a square, a triangle, a pentagon, or a hexagon when viewed in the short direction.

The reel wire 12 has a connector 12*a* at its end, and is attached to the lighting element 3 via the connector 12*a*. The reel wire 12 is protruded downward from the lower part of the lighting elevating apparatus 1. To be more specific, the lighting element 3 attached to the end of the reel wire 12 is suspended downward from the lighting elevating apparatus 1.

The reeling guide 13 is a rotor having a cylindrical shape. The reeling guide 13 is arranged such that its longitudinal direction is parallel to the longitudinal direction of the reel 11, and touches the reel wire 12 reeled on the reel 11. As a result of the rotation of the reel 11, the reeling guide 13 who has touched the reel wire 12 that has been reeled on the reel 11 counter-rotates with respect to the rotation of the reel 11 around an axis in a short direction of the reeling guide 13. Since the reeling guide 13 touches the reel wire 12, it is desirable that the reeling guide 13 be made of elastic material such as a sponge, resin, or rubber in order to avoid damage on the reel wire 12. It should be noted that the shape of the reeling guide 13 is not limited to the cylindrical shape, but may be a rectangular shape when viewed in the longitudinal direction and may be any equilateral isogon such as a square, a triangle, a pentagon, or a hexagon when viewed in the short direction.

The guide screw 15 is arranged such that its longitudinal direction is parallel to the longitudinal direction of the reel 11, and is rotated around an axis in its short direction in conjunction with the rotation of the reel 11 and/or the reeling guide 13. The guide screw 15 includes a guide ring 15*a* and a ring block 15*b*.

The guide ring 15*a* is a rotor having a cylindrical shape, and the guide screw 15 is inserted through an axial bore of the guide ring 15*a*. The bottom of the ring block 15*b* abuts on the guide ring 15*a*, and the guide screw 15 is inserted through an axial bore of the ring block 15*b*. The guide ring 15*a* rotates in conjunction with the rotation of the guide screw 15, and moves vertically along the guide screw 15 such that the side face of the guide ring 15*a* in its longitudinal direction faces the topmost part of the reel wire 12 which has been reeled on the reel 11. The ring block 15*b* moves vertically in conjunction with the vertical movement of the guide ring 15*a* and controls the downward movement of the guide ring 15*a*. The reel wire 12 runs, along with the rotation of the guide ring 15*a*, through the side face of the guide ring 15*a* in the longitudinal direction, the clutch 16, and the pulley 17, and protrudes through the lower part of the lighting elevating apparatus 1. One rotation of the guide ring 15*a* causes the reel wire 12 to be reeled by one rotation of the reel 11.

The clutch 16 is a rotor arranged below the reel 11. The clutch 16 is rotated in accordance with the movement of the reel wire 12.

The column 18 has a cylindrical shape, and is arranged such that its longitudinal direction is parallel to the longitudinal direction of the reel 11 to support the casing 10. The column 18 also plays a role to avoid the displacement and/or slack of the reel wire 12, and its details will be described later. It should be noted that the shape of the column 18 is not limited to the cylindrical shape, but may be a rectangular shape when viewed in the longitudinal direction and may be any equilateral isogon such as a square, a triangle, a pentagon, or a hexagon when viewed in the short direction.

The attaching part 19 has a screw-type or bolt-and-nut-type structure, and is a member for attaching the lighting elevating apparatus 1 on the suspension baton 2. The attaching part 19 allows the lighting elevating apparatus 1 to be attached to the suspension baton 2, and the lighting elevating apparatus 1 is suspended from the suspension baton 2. The attaching hook 20 has a structure in which a hook and a wire are interlocked to each other, and plays a role to prevent the lighting elevating apparatus 1 from being detached from the suspension baton 2.

Figure 4A:
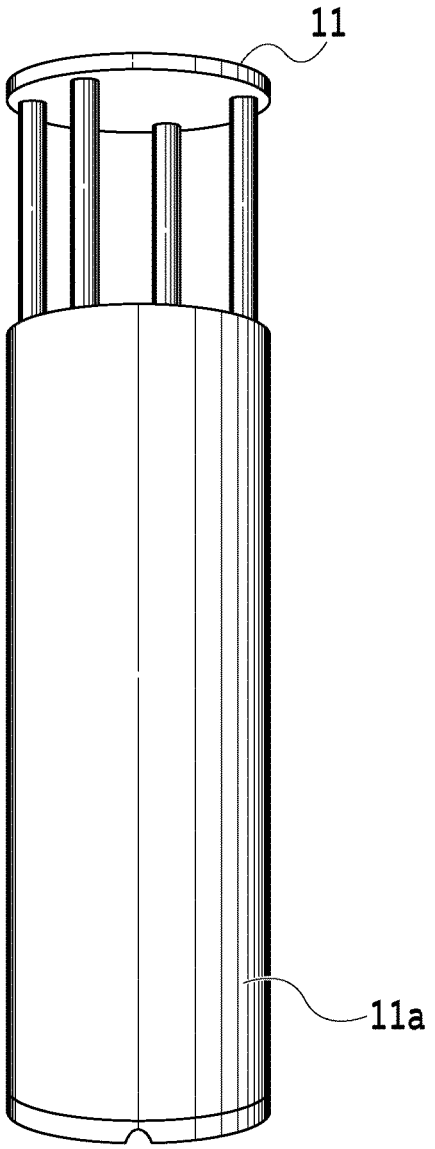
FIG. 4A is a view showing details of a reel according to the first embodiment of the present invention.
Figure 4B:
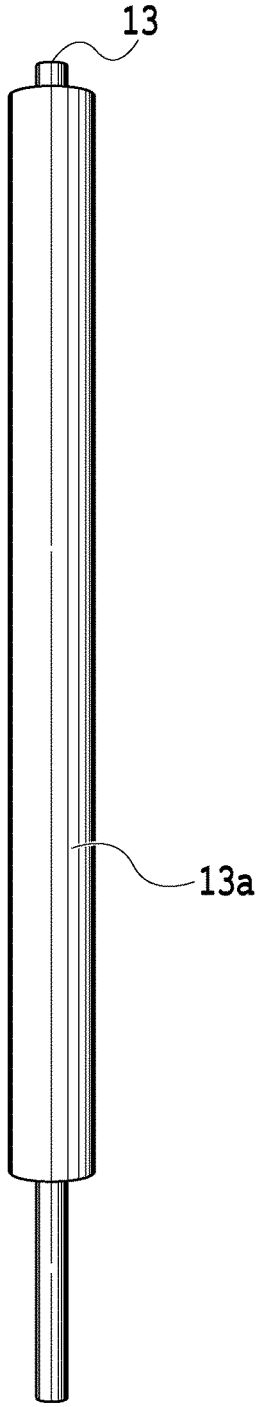
FIG. 4B is a view showing details of a reeling guide according to the first embodiment of the present invention.

Next, with reference to FIGS. 4A and 4B, the details of the reel 11 and the reeling guide 13 will be explained. As shown in FIG. 4A, the reel 11 has a reel wire reeling face 11*a*, the part of which the reel wire 12 is to be reeled up. As shown in FIG. 4B, the reeling guide 13 has a reel wire touching part 13*a*, and this part touches, in accordance with the rotation of the reeling guide 13, the reel wire 12 to be reeled on the reel wire reeling face 11*a*. The reeling guide 13 includes a cylindrical core made of aluminum or the like and a member wrapping therearound which is made of sponge or the like.

The reel 11 and the reeling guide 13 are arranged in parallel to each other, and the reel wire reeling face 11*a* and the reel wire touching part 13*a* face each other in their longitudinal directions. The reel wire touching part 13*a* has a length, in the longitudinal direction, of at least the same as or larger than that of the reel wire reeling face 11*a*. To be more specific, the reel wire touching part 13*a* is configured so as to cover the facing surface of the entire reel wire reeling face 11*a*. Due to such a configuration, the whole reel wire 12 to be reeled up on the reel wire reeling face 11*a* touches the reel wire touching part 13*a*.

Figure 5:
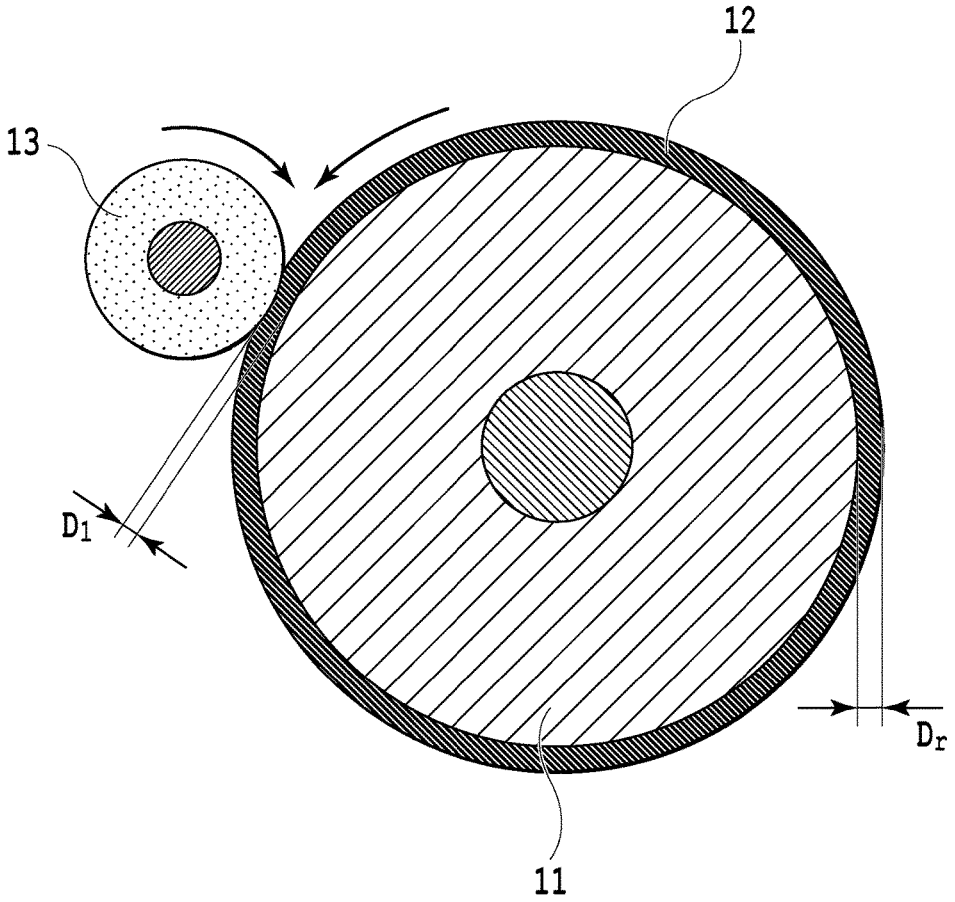
FIG. 5 is a cross-sectional view showing the interrelations between the reel, a reel wire, and the reeling guide according to the first embodiment of the present invention.

Next, with reference to FIG. 5, a cross-sectional view shows the interrelations between the reel 11, the reel wire 12, and the reeling guide 13 when reeling the reel wire 12 on the reel wire reeling face 11*a*. FIG. 5 illustrates a cross section viewed from the above in the state in which the lighting elevating apparatus 1 is suspended from the suspension baton 2.

As shown in FIG. 5, the reel 11 rotates counterclockwise around the axis of the face in a short direction of the reel 11, and the reel wire 12 is also reeled counterclockwisely on the reel wire reeling face 11*a* in accordance with the rotation of the reel 11. The reeling guide 13 rotates clockwise in conjunction with the rotation of the reel 11. The reel 11 and the reeling guide 13 mutually rotate in opposite directions, and the reel wire 12 passes therebetween. A distance $D_1$ between the reel 11 and the reeling guide 13 is at least equal to or less than a diameter $D_r$ of the reel wire 12.

While the reel 11 and the reeling guide 13 mutually rotate in opposite directions, forces in two directions shown in FIG. 5 are applied to the reel wire 12 passing between the reel 11 and the reeling guide 13. Due to such a structure, the reel wire 12 is pinched between the reel 11 and the reeling guide 13, thereby allowing to prevent one lap of the reel wire 12 from overlapping with another when reeling the reel wire 12. Incidentally, by configuring the reel wire touching part 13*a* of the reeling guide 13 to be made of highly elastic material and configuring a distance between the reeling guide 13 and the reel wire reeling face 11*a* to be shorter (by setting $D_1$ to be less than $D_r$), the reeling of the reel wire 12 is constantly smooth and the overlapping of the reel wire 12 is surely avoided.

In the present embodiment, the counterclockwise rotation of the reel 11 has been exemplified, but the reel 11 may be rotated clockwise. In such a case as well, the reeling guide 13 should rotate counterclockwise so that they mutually rotate in opposite directions to avoid the overlapping of the reel wire 12.

As described above, it should be noted that in the case where the reel 11 and/or the reeling guide 13 has/have a rectangular shape when viewed in the longitudinal direction and an equilateral isogonal shape such as a square, a triangle, a pentagon, or a hexagon when viewed in the short direction, an effect similar to the above-described effect can be obtained. In this case, both the reel 11 and the reeling guide 13 should have the same shape and area, and each of their corners should be configured to touch the reel wire 12 simultaneously. Further, if either one of the reel 11 and the reeling guide 13 has a cylindrical shape, the other should have an equilateral isogonal shape to obtain an effect similar to the above-described effect.

Figure 6A:
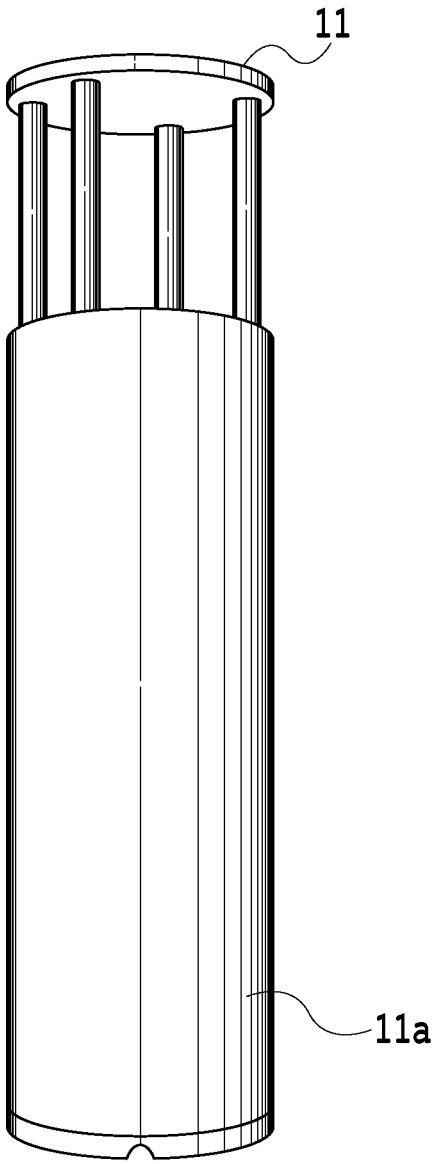
FIG. 6A is a view showing details of the reel according to the first embodiment of the present invention.
Figure 6B:
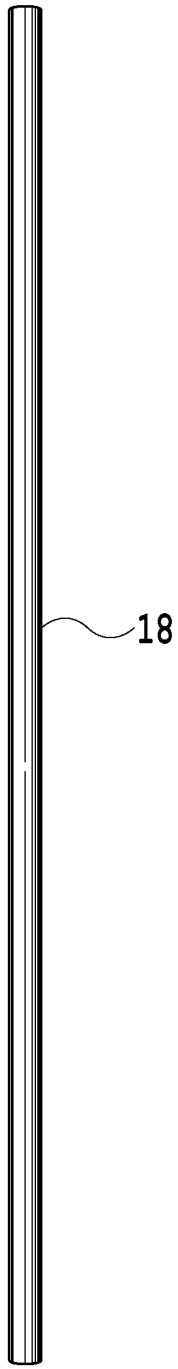
FIG. 6B is a view showing details of a column according to the first embodiment of the present invention.

Next, with reference to FIGS. 6A and 6B, the details of the reel 11 and the column 18 will be explained. The reel 11 has the same structure as the one explained in FIG. 4A, and thus its explanation will be omitted. As shown in FIG. 6B, the column 18 is arranged in parallel to the reel 11, and faces the reel wire reeling face 11*a* in the longitudinal direction. The column 18 has a length, in the longitudinal direction, of at least the same as or larger than that of the reel wire reeling face 11*a*. To be more specific, the column 18 is configured so as to cover the facing surface of the entire reel wire reeling face 11*a*. Due to such a configuration, the whole reel wire 12 to be reeled up on the reel wire reeling face 11*a* passes between the reel wire touching part 13*a* and the column 18.

Figure 7:
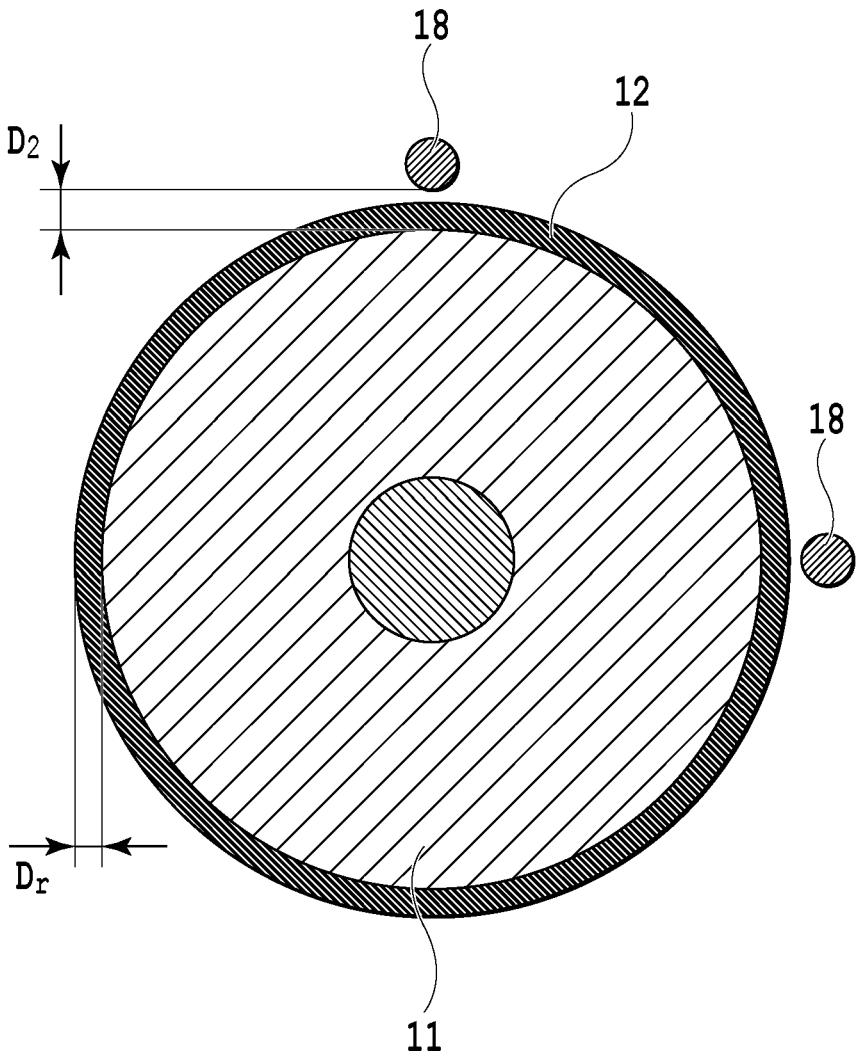
FIG. 7 is a cross-sectional view showing the interrelations between the reel, the reel wire, and the column according to the first embodiment of the present invention.

Next, with reference to FIG. 7, a cross-sectional view shows the interrelations between the reel 11, the reel wire 12, and the column 18 when reeling the reel wire 12 on the reel wire reeling face 11*a* of the reel 11. FIG. 7 illustrates a cross section viewed from the above in the state in which the lighting elevating apparatus 1 is suspended from the suspension baton 2.

As shown in FIG. 7, a distance $D_2$ between the reel 11 and the column 18 and a diameter $D_r$ of the reel wire 12 satisfy the following relation:

$D_2 < D_r \times 2$ and $D_2 > D_r$

As described above, since the distance $D_2$ between the reel wire reeling face 11*a* and the column 18 is larger than the diameter $D_r$ of the reel wire 12, the reel wire 12 to be reeled on the reel wire reeling face 11*a* does not touch the column 18. This structure can avoid abrasion caused by the reel wire 12 touching the column 18. In addition, since the distance $D_2$ between the reel wire reeling face 11*a* and the column 18 is less than twice the diameter $D_r$ of the reel wire 12, a lap of the reel wire 12 to be reeled on the reel wire reeling face 11*a* does not overlap with another. Due to this structure, the overlapping of the reel wire 12 is further surely avoided in addition to the above-described function of the reeling guide 13.

Incidentally, although the number of columns 18 is not particularly limited, the columns 18 are desirably arranged in plural when considering that the casing 10 covers the entire lighting elevating apparatus 1. Due to the arrangement of the plurality of columns 18, the overlapping of the reel wire 12 is surely avoided.

Further, in the case when the reel 11 and/or the column 18 has/have a rectangular shape when viewed in the longitudinal direction and an equilateral isogonal shape such as a square, a triangle, a pentagon, or a hexagon when viewed in the short direction, an effect similar to the above-described effect can also be obtained.

Figure 8:
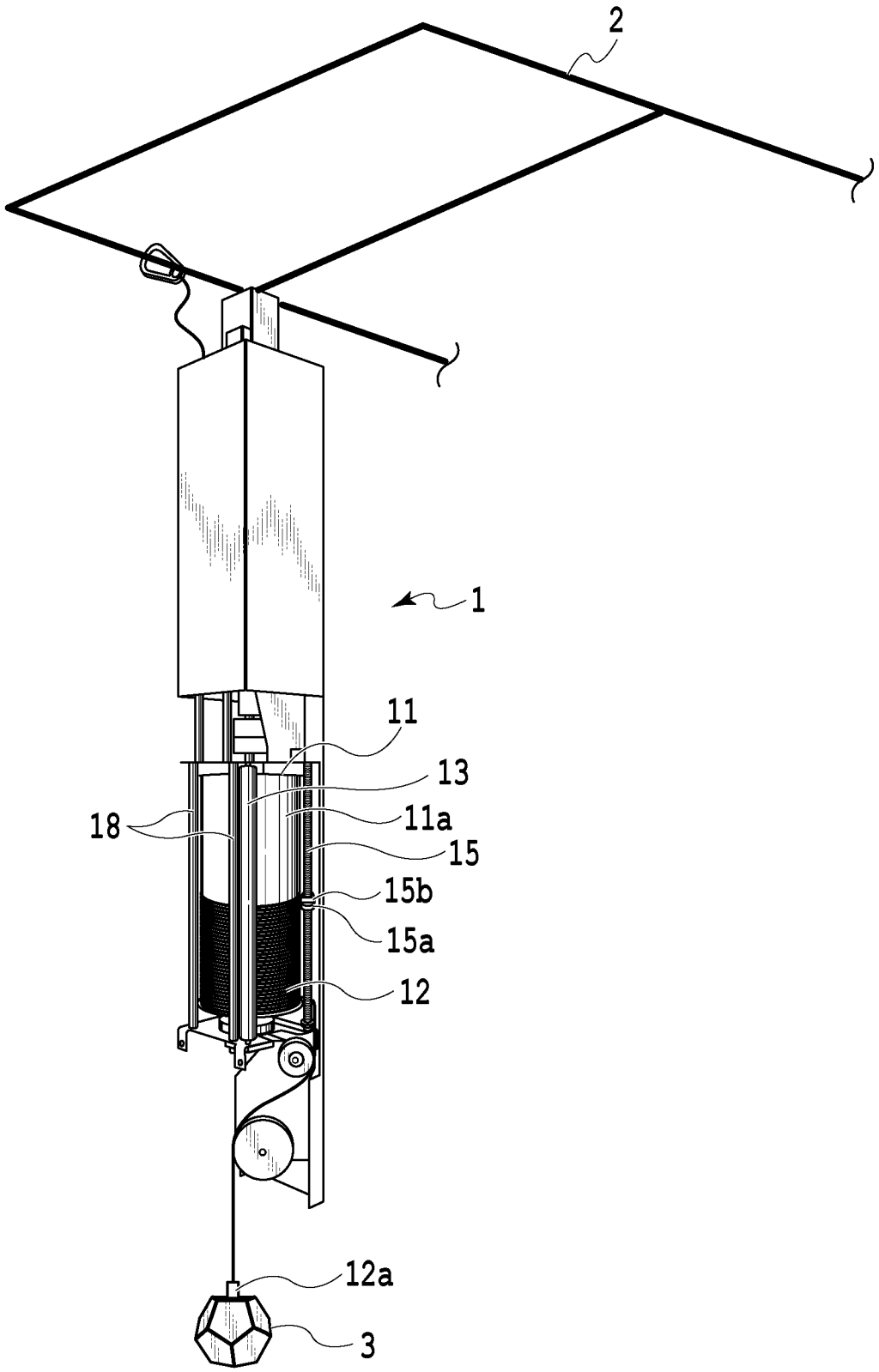
FIG. 8 is a view showing the state of reeling the reel wire on the reel according to the first embodiment of the present invention.

Next, with reference to FIG. 8, the operation of reeling the reel wire 12 on the reel wire reeling face 11*a* will be explained. As shown in FIG. 8, the lighting elevating apparatus 1 according to the present embodiment is suspended from the suspension baton 2 with its longitudinal direction being vertically set, and the lighting element 3 connected to the reel wire 12 is suspended downward from the lighting elevating apparatus 1. The reel wire 12 is suspended downward from the lighting elevating apparatus 1 in the state where the gravity force is applied by the weight of the reel wire 12 and the weight of the lighting element 3 connected thereto.

In the state where the lighting elevating apparatus 1 is suspended from the suspension baton 2, each of the reel 11, the reeling guide 13, the guide screw 15, and the column 18 is in the vertical state in its longitudinal direction. The reel 11, the reeling guide 13, the guide screw 15, and the column 18 are arranged in parallel to one another, and each of them faces one another in the longitudinal direction. The guide ring 15*a* moves vertically so as to face the topmost part of the reel wire 12 which has been reeled on the reel wire reeling face 11*a*. In this structure, the reel wire 12 is reeled up, through the guide ring 15*a*, on the reel wire reeling face 11*a* in a lateral direction and simultaneously upward of the reel wire reeling face 11*a*.

As described above, the reel wire 12 does not overlap upon the reeling due to the above-described functions of the reeling guide 13 and the column 18. Moreover, since the gravity force of the reel wire 12 is applied, the laps of the reel wire 12 adjoin each other due to such gravity upon the reeling of the reel wire 12, thereby causing no displacement as described above. Further, the guide ring 15*a* moves vertically in accordance with the reeling of the reel wire 12, thereby causing the reel wire 12 to be regularly reeled up.

As described above, since the reel 11 and the reeling guide 13 mutually rotate in opposite directions when reeling the reel wire 12 on the reel 11, the reel wire 12 passing through the reel 11 and the reeling guide 13 is pinched therebetween, thereby allowing to prevent one lap of the reel wire 12 from overlapping with another. In addition, by setting the above-described distance between the reel 11 and the column 18, the overlapping of the reel wire 12 is further surely avoided. Moreover, the gravity force applied to the reel wire 12 can avoid displacement of the reeling of the reel wire 12. Consequently, the lighting elevating apparatus 1 according to the present embodiment has a simple and lightweight structure and thus can avoid the displacement and/or slack of the reel wire.

Incidentally, although not shown in FIG. 8, a one-way clutch of a sprag type or a cam type may be used for the clutch 16. In this case, the clutch 16 may be configured to rotate only when the reel wire 12 is guided downward (i.e., when the reel wire 12 is unreeled and the lighting element 3 descends) and may be configured not to rotate when the reel wire 12 is guided upward (i.e., when the reel wire 12 is reeled up and the lighting element 3 ascends). Due to this configuration, the gravity force applied to the reel wire 12 upon its reeling is unlikely to be offset and thus the above-described reel wire is less likely to be displaced.

Here, the above-described configuration regarding the distance between the reel 11 and the column 18 described in the present embodiment is not necessarily essential. In the case of not having the above-described configuration, the overlapping of the reel wire 12 is to be avoided only by the function of the reeling guide 13.

Second Embodiment

Figure 9:
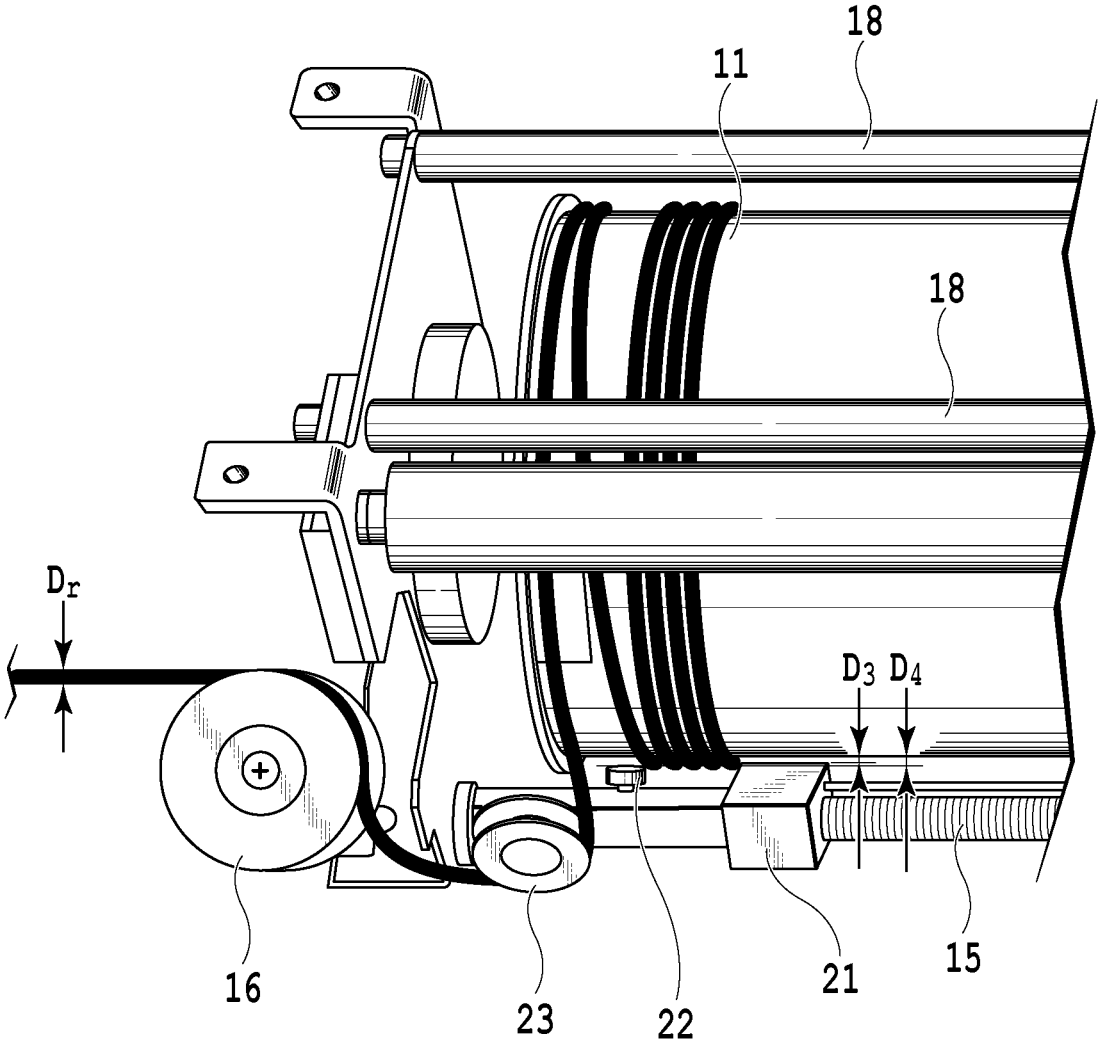
FIG. 9 is a view showing a lighting elevating apparatus including a reel wire fixing part and a guide ring according to a second embodiment of the present invention.

Next, with reference to FIG. 9, the lighting elevating apparatus 1 according to a second embodiment of the present invention will be explained. In comparison of the lighting elevating apparatus 1 according to the present embodiment with the lighting elevating apparatus according to the first embodiment, a difference is found in the guide screw 15. As shown in FIG. 9, the guide screw 15 includes a guide block 21, and includes a reel wire fixing part 22 below the guide block 21, and further includes a guide ring 23 below the reel wire fixing part 22.

The guide block 21 has a surface facing the reel wire reeling face 11*a*. The guide screw 15 is inserted through an axial bore of the guide block 21, which moves vertically along the guide screw 15 in conjunction with the rotation of the guide screw 15. This vertical movement is configured to interlock the reeling of the reel wire 12 on the reel wire reeling face 11*a*. A small clearance exists between the reel wire reeling face 11*a* and the facing surface of the guide block 21, and a distance $D_3$ of this clearance is less than the diameter $D_r$ of the reel wire 12.

The reel wire fixing part 22 is protruded from the guide screw 15 which is arranged in parallel to the reel 11, and faces the lower part of the reel wire reeling face 11*a* of the reel 11 in a longitudinal direction. A small clearance exists between the reel wire reeling face 11*a* and the reel wire fixing part 22, and a distance $D_4$ of this clearance is less than the diameter $D_r$ of the reel wire 12.

The guide ring 23 is arranged below the reel wire fixing part 22 of the guide screw 15, and guides the reel wire 12 guided by the pulley 17. The reel wire 12 passes along a curved face of the guide ring 23 through the reel wire fixing part 22 and the guide block 21, and thus is guided upward.

A starting portion of the reeling of the reel wire 12 is fixed at the lower part by the reel wire fixing part 22, and is reeled on the reel wire reeling face 11*a* in conjunction with the upward movement of the guide block 21. As such, the starting point of the reeling of the reel wire 12 is fixed, and thus the slack of the reel wire upon its reeling can further be avoided. Further, since the reel wire 12 is reeled in conjunction with the upward movement of the guide block 21, the reel wire 12 can be regularly reeled up.

According to the present embodiment, it has been exemplified that the reel wire fixing part 22 and the guide ring 23 are arranged on the guide screw 15, but this may not be limited to such a configuration. For example, like the one described above, the reel wire fixing part 22 and the guide ring 23 may be arranged on the column 18. Further, the reel wire fixing part 22 may be arranged on the guide screw 15 and the guide ring 23 may be arranged on the column 18, or vice versa.

Figure 10:
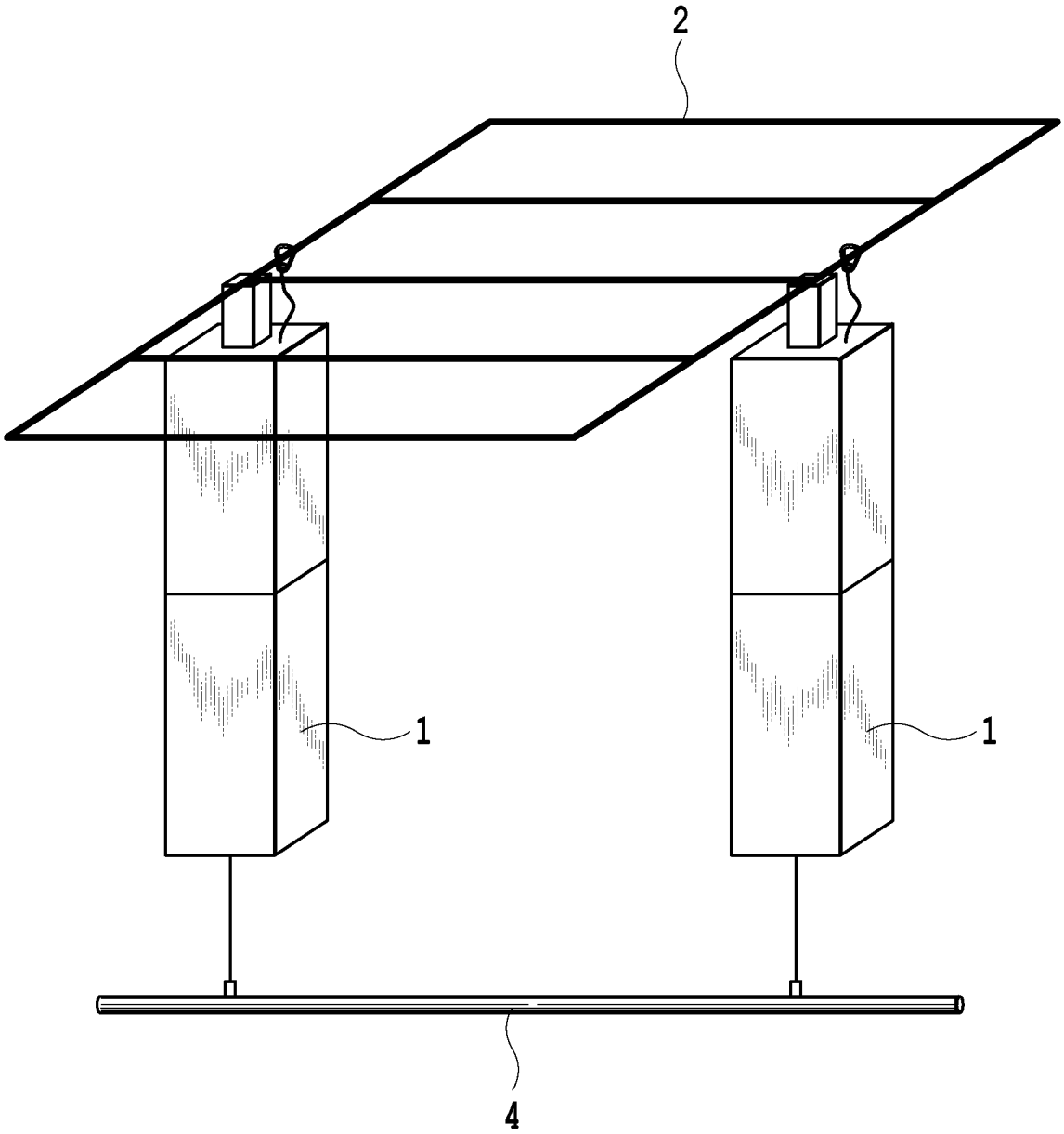
FIG. 10 is a view showing an entire lighting system according to a third embodiment of the present invention.
Figure 11:
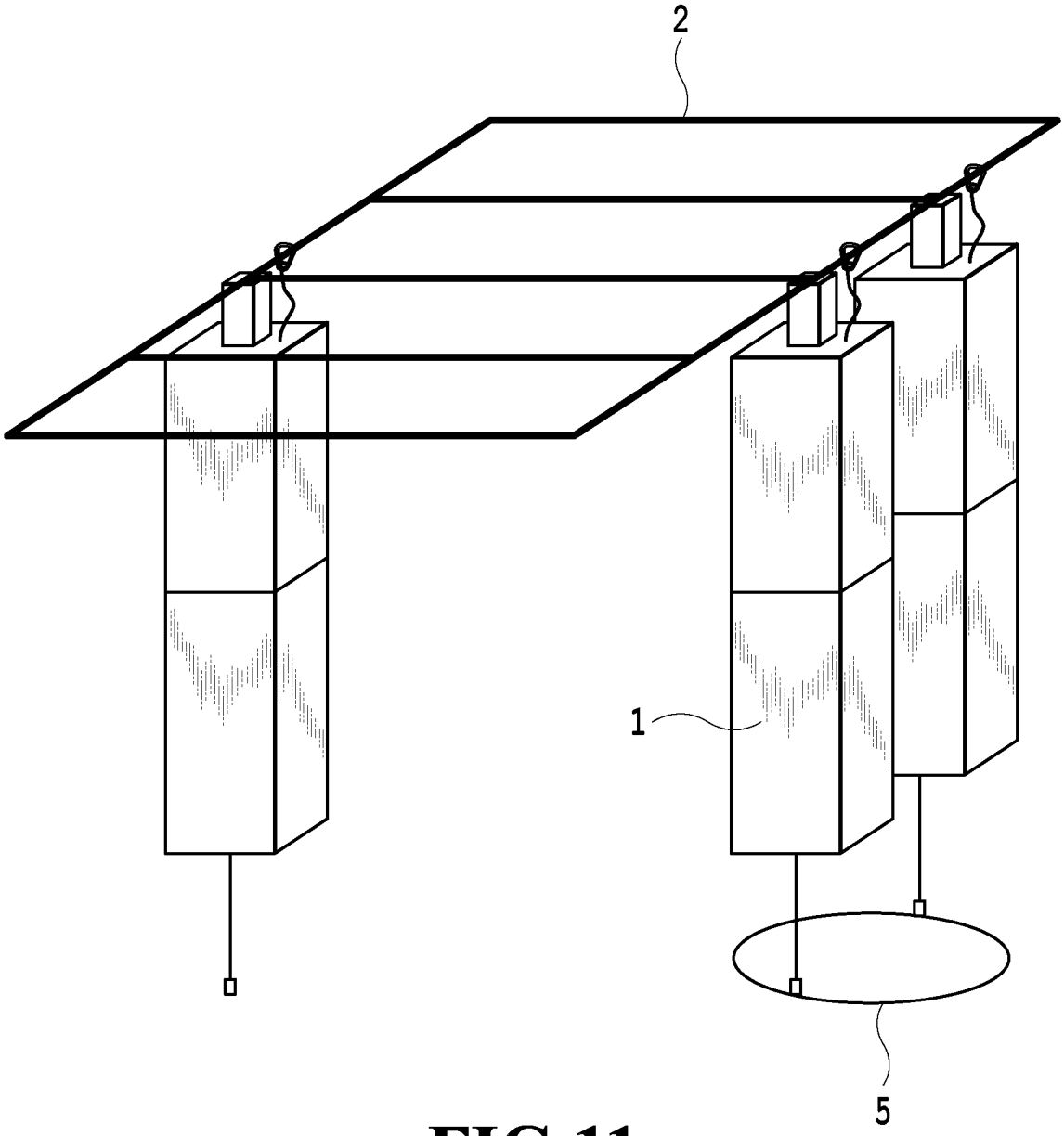
FIG. 11 is a view showing an entire lighting system according to a fourth embodiment of the present invention.

Further, according to the present embodiment, it is exemplified that the lighting element 3 is attached to the connector 12*a* of the reel wire 12, but this is not limited to such an example. For example, as shown in FIG. 10, a rectangular (rod-like) lighting element device 4 having a plurality of lighting elements incorporated therein may be suspended from a plurality of the lighting elevating apparatuses 1 (a third embodiment). In this configuration, by elevating the lighting element device, an effect that differs from the configuration described in the embodiments can be produced in conjunction with light emitted from the plurality of lighting elements. Further, as shown in FIG. 11, a mirror 5 may be suspended instead of suspending the lighting element 3 (a fourth embodiment). In this configuration, a light source (not shown) may be arranged on the ceiling of the stage or the like to irradiate the mirror 5 with light from the lighting system, and the mirror 5 may be configured to make elevation. Thus, this configuration can also produce an effect that is different from the ones described in the embodiments.

Also, configuring to suspend combinations of any two or more of the above-described lighting element 3, lighting element device 4, and mirror from the plurality of lighting elevating apparatuses 1 and to control those elevation (by software control) can produce an even greater effect. For example, by chronologically elevating each of the above-described plurality of combinations, a three-dimensional performance can be created.

REFERENCE SIGNS LIST

1 LIGHTING ELEVATING APPARATUS
2 SUSPENSION BATON
3 LIGHTING ELEMENT
4 LIGHTING ELEMENT DEVICE
5 MIRROR
10 CASING
11 REEL
11A REEL WIRE REELING FACE
12 REEL WIRE
12A CONNECTOR
13 REELING GUIDE
13A REEL WIRE TOUCHING PART
14 ELECTRIC MOTOR
15 GUIDE SCREW
15A GUIDE RING
15B RING BLOCK
16 CLUTCH
17 PULLEY
18 COLUMN
19 ATTACHING PART
20 ATTACHING HOOK
21 GUIDE BLOCK
22 REEL WIRE FIXING PART
23 GUIDE RING

The invention claimed is:

1. A lighting elevating apparatus comprising:

a reel including a reel wire reeling face and being arranged such that its longitudinal direction is in a vertical state, wherein the reel is coupled to an electric motor and is rotated around an axis of a surface in a short direction of the reel by the electric motor;

a reel wire to be reeled on the reel wire reeling face by the rotation of the reel;

a reeling guide including a reel wire touching part facing the reel wire reeling face and being arranged in parallel to the reel, wherein a distance between the reel wire reeling face and the reel wire touching part is equal to or less than a diameter of the reel wire; and a connector attached to an end of the reel wire to connect a to-be-lifted object that is to be suspended below the lighting elevating apparatus, wherein the reeling guide counter-rotates with respect to the rotation of the reel; and the reel wire passes between the reel wire reeling face and the reel wire touching part, and is reeled upwardly while being suspended downwardly from the lighting elevating apparatus in a state where gravity force is applied by weight of the reel wire and the to-be-lifted object.

2. The lighting elevating apparatus according to claim 1, further comprising a guide screw which includes a guide ring facing the reel wire reeling face to guide the reel wire and which is arranged in parallel to the reel, wherein:

the guide screw rotates in conjunction with the rotation of the reel and is inserted through an axial bore of the guide ring; and the guide ring rotates in conjunction with the rotation of the guide screw and moves vertically along the guide screw so as to face a topmost part of the reel wire which has been reeled on the reel wire reeling face.

3. The lighting elevating apparatus according to claim 1, further comprising a guide screw which includes a reel wire fixing part and a guide block which face the reel wire reeling face and which are arranged in parallel to the reel, wherein:

the reel wire fixing part is arranged below the guide screw and faces a lower part of the reel wire reeling face in the longitudinal direction;

the guide screw rotates in conjunction with the rotation of the reel and is inserted through an axial bore of the guide block;

the guide block moves vertically in conjunction with the rotation of the guide screw along the guide screw;

a distance between the reel wire reeling face and the reel wire fixing part is less than a diameter of the reel wire; and the reel wire passes, when reeled on the reel wire reeling face, between the reel wire fixing part and the guide block and is guided in an upward direction of the reel wire reeling face.

4. The lighting elevating apparatus according to claim 1, further comprising a column which faces the reel wire reeling face and which is arranged in parallel to the reel, wherein a distance between the reel wire reeling face and the column is equal to or larger than the diameter of the reel wire and is less than twice the diameter of the reel wire.

5. The lighting elevating apparatus according to claim 1, further comprising a clutch which is arranged below the reel and which is rotated by touching the reel wire, wherein:

the reel wire is guided below the lighting elevating apparatus along the clutch; and the clutch:

rotates along with the movement of the reel wire when the reel wire is unreeled from the reel wire reeling face; and does not rotate along with the movement of the reel wire when the reel wire is reeled on the reel wire reeling face.

* * * * *